US010988905B2

(12) United States Patent
Gu et al.

(10) Patent No.: US 10,988,905 B2
(45) Date of Patent: Apr. 27, 2021

(54) HARBOUR PLANT AND METHOD FOR MOORING A FLOATING BODY IN A HARBOUR PLANT

(71) Applicant: Gravifloat AS, Bergen (NO)

(72) Inventors: Weiguang Gu, Singapore (SG); Åge Wallentinsen, Bergen (NO); Stig Rau Andersen, Bergen (NO)

(73) Assignee: Gravifloat AS, Bergen (NO)

( * ) Notice: Subject to any disclaimer, the term of this patent is extended or adjusted under 35 U.S.C. 154(b) by 15 days.

(21) Appl. No.: 16/336,798

(22) PCT Filed: Oct. 25, 2017

(86) PCT No.: PCT/IB2017/056605

§ 371 (c)(1),
(2) Date: Mar. 26, 2019

(87) PCT Pub. No.: WO2018/078534

PCT Pub. Date: May 3, 2018

(65) Prior Publication Data

US 2020/0024816 A1 Jan. 23, 2020

(30) Foreign Application Priority Data

Oct. 27, 2016 (NO) ..... 20161699

(51) Int. Cl.
*E02B 17/02* (2006.01)
*B63B 43/06* (2006.01)
(Continued)

(52) U.S. Cl.
CPC ..... *E02B 17/00* (2013.01); *E02B 17/08* (2013.01); *E02B 2017/0043* (2013.01); *E02B 2017/0056* (2013.01)

(58) Field of Classification Search
CPC ... B63B 35/285; B63B 43/06; B63B 2738/10; B63C 1/00; B63C 1/02; B63C 1/04;
(Continued)

(56) References Cited

U.S. PATENT DOCUMENTS 1,335,497 A * 3/1920 Hamilton ..... B63B 1/02 405/3
1,380,141 A * 5/1921 Hamilton ..... E02C 5/02 405/3
(Continued)

FOREIGN PATENT DOCUMENTS

JP S5383294 A 7/1978
JP S5448935 A 4/1979
(Continued)

*Primary Examiner* — Edwin J Toledo-Duran
(74) *Attorney, Agent, or Firm* — Cesari & McKenna, LLP

(57) ABSTRACT

Various embodiments relate to a method and a harbour plant for mooring a floating body. The harbour plant includes a piled base structure provided with two upwards through sea level projecting sidewalls terminated above sea level and a laterally arranged bottom structure interconnecting the sidewalls, where a top surface of the bottom structure is arranged at a depth allowing the floating body to be floated in between the sidewalls, and where the floating body is arranged to be rigidly, but releasably supported by at least parts of the sidewalls. The method includes bringing the floating body into a position between the sidewalls and fixing rigidly the floating body to the vertical sidewalls of the base structure and still exposing the floating body more or less fully to buoyancy by allowing a water-filled gap at least between bottom of the floating body and a corresponding upper surface of the base structure.

20 Claims, 11 Drawing Sheets

(51) Int. Cl.
*E02B 17/00* (2006.01)
*E02B 17/08* (2006.01)

(58) Field of Classification Search
CPC .... B63C 1/06; B63C 3/08; B63C 5/04; B63G 2008/425; B65D 88/78; E02B 17/02; E02B 2017/0039; E02B 2017/0082; E02B 2017/0086; F17C 3/005
USPC ..... 405/4, 7, 203–205, 210; 62/50.2, 53.1; 220/560, 560.11; 114/45, 256, 257
See application file for complete search history.

(56) References Cited

U.S. PATENT DOCUMENTS 1,617,990 A * 2/1927 Donnelly ..... B63B 1/02 114/45
2,465,851 A * 3/1949 Crandall ..... B63C 1/04 114/46
2,740,367 A * 4/1956 Engstrand ..... B63C 1/02 114/45
3,472,033 A * 10/1969 Brown ..... B65D 88/78 405/210
3,592,155 A * 7/1971 Rosenberg ..... B63B 5/18 114/265
3,610,192 A * 10/1971 Mauritzen ..... B63B 35/42 114/45
3,688,719 A * 9/1972 Amirikian ..... B63C 1/08 114/267
3,710,582 A * 1/1973 Hills ..... B65D 88/78 405/210
3,766,583 A * 10/1973 Phelps ..... F25J 1/0265 405/203
3,777,497 A * 12/1973 Edwards ..... B65D 88/78 405/210
3,811,583 A * 5/1974 Weeks ..... B63C 3/12 414/800
3,977,346 A * 8/1976 Natvig ..... B63B 77/00 114/65 R
4,111,144 A * 9/1978 Ingvason ..... B63C 1/02 114/48
4,140,426 A * 2/1979 Knox ..... E02B 17/0008 405/225
4,200,411 A * 4/1980 Brown ..... B65D 88/78 114/257
4,227,828 A * 10/1980 Ivanov ..... B63C 5/04 114/65 R
4,484,841 A * 11/1984 Einstabland ..... E02B 17/0021 405/212
4,701,143 A * 10/1987 Key ..... B63B 21/507 441/5
4,762,442 A * 8/1988 Thomas ..... E02B 17/021 405/196
5,178,488 A * 1/1993 Stokoe ..... G01G 19/14 405/3
5,522,680 A * 6/1996 Hoss ..... E02B 17/00 405/209
5,860,765 A * 1/1999 Cruchelow ..... B63C 1/02 114/263
9,664,338 B2 * 5/2017 Hata ..... F17C 7/04
2003/0140837 A1 * 7/2003 O'Neil ..... B63B 35/42 114/259
2005/0139595 A1 * 6/2005 Pepin-Lehalleur ..... E02B 17/02 220/4.13
2009/0324341 A1 * 12/2009 Grinberg ..... E02D 23/02 405/205
2012/0020742 A1 * 1/2012 Mahmoud ..... B65D 88/78 405/224
2012/0321387 A1 * 12/2012 del Campo y Ruiz de Almodovar ..... B63C 3/06 405/1
2017/0183835 A1 * 6/2017 Lee ..... B65D 88/74
2019/0127939 A1 * 5/2019 Kjersem ..... E21B 15/02

FOREIGN PATENT DOCUMENTS

JP S57175583 A 10/1982
JP S5822398 U 2/1983
JP S634110 A 1/1988
JP S63207789 A 8/1988
JP H11240484 A 9/1999
JP 2011/521818 A 7/2011
JP 2017/537246 A 12/2017
KR 2014/0048834 A 4/2014
WO WO-2006/041312 A1 4/2006
WO WO-2016/085347 A1 6/2016
WO WO-2017/168381 A1 10/2017

* cited by examiner

HARBOUR PLANT AND METHOD FOR MOORING A FLOATING BODY IN A HARBOUR PLANT

CROSS-REFERENCE TO RELATED APPLICATIONS

This application is the National Stage of International Application No. PCT/IB2017/056605, filed 25 Oct. 2017, which claims the benefit of priority of Norwegian patent application No. 20161699, filed 27 Oct. 2016, the contents of both being hereby incorporated by reference in their entirety for all purposes.

TECHNICAL FIELD OF THE INVENTION

The invention relates to a method and a system for mooring a floating body in a harbour plant comprising a piled base structure provided with two side walls projecting upwards through the sea level, terminated above sea level and a laterally arranged bottom structure rigidly interconnecting the side walls, where a top surface of the bottom structure is arranged at a depth allowing the floating body to be floated in between the two side walls, and where the floating body (or floating structure) is arranged to be rigidly, but releasably supported by at least parts of the side walls.

BACKGROUND OF THE INVENTION

A major problem exists for floating offshore structures in waters exposed to extreme sea conditions with e.g. storm surges. It is well known that storm surges mostly appear in shallow waters near land, e.g. in connection with tropical cyclones, where water levels near shore may temporarily increase by up to 8-9 meters. This will impose huge uplift forces onto a Gravity Based Structure (GBS) with liquids storage with large water plane area at sea level and being located near shore. The additional fixed ballast volumes to counteract such temporary uplift forces will necessitate significant increase of the GBS volume and weight to secure positive bottom pressure at all times, but also to secure additional buoyancy during float-in, submergence and installation of the GBS onto the seabed. Such increase in volume will again result in further increase of uplift forces, necessitating additional ballast volumes for both sea water ballast and fixed ballast, —representing a negative design effect spiral which will make a GBS solution very costly.

It is also known that GBS solutions may not be feasible or at best will be very expensive for use in soft and unconsolidated seabed soils, such as found in river deltas. For such reasons the GBS may be equipped with suction skirts, but the mere size and vertical height of such skirt solutions may represent prohibitively expensive foundation solutions, having to date made floating storage bodies the only viable solution in areas with such soil conditions.

To reduce the problems associated with the dynamics of the floating bodies during loading operations, it has been proposed to install large, rectangular or square steel or concrete structures on the seabed, functioning as artificial harbours, where a continuous steel or concrete wall is intended to form a protection from incoming waves. Typical depths of water proposed are 8-30 metres. This type of large constructions is intended to be built away from populated areas and at the same time functioning as a breakwater for the liquefied natural gas (LNG) ships during loading and unloading operations.

The problem with waves can be reduced by moving the ship over to the leeward side of the harbour construction, but calculations and basin experiments have shown that the harbour construction which forms a continuous barrier must be built to be very large if one is to obtain a significant shielding effect when waves and swells come during one period from a particularly unfavourable angle. This is due to the well known effect that ocean waves will be diffracted around both sides of such a construction and a focal point will arise some distance behind the leeward side where the diffracted waves meet. At this focal point, the height of the waves can actually be higher than the incoming waves.

A large harbour construction placed on the ocean bottom, intended to act as a shield from the waves, will therefore be very costly. Different forms for such types of harbour sites for LNG built in concrete for shielding vessels from the waves during loading operations have been suggested. One suggested shape is, for example, to build the construction as a horseshoe and let the LNG vessels load/unload inside this. This will reduce the dynamics considerably, but the harbour site will be even more costly than a harbour site in the shape of a rectangle.

GB 1369915 describes a harbour site comprising a number of units that are afloat or sunk and otherwise constructed for placement on the seabed. Each unit comprises a base, load-carrying structure and moveable wave-breaking elements that can be moved if required.

U.S. Pat. No. 3,958,426 describes a harbour site comprising a number of units placed apart on the seabed, so that at least one straight mooring location is formed. The units are provided with fenders and wave dampening devices.

WO 2006/041312 discloses a harbour plant for storage, loading and unloading hydrocarbons such as LNG at sea, the whole content of which hereby being included by the reference. The harbour comprises three units built from steel or concrete, placed on the seabed. The units are placed in sidewise relation in-line. The harbour is configured to dampen the waves, the vessel being intended to lie on the leeward side of the mooring.

WO 2013/002648 discloses a harbour plant for storage, loading and unloading of hydrocarbon products at sea, comprising a number of units being mutually placed on the seabed so that a harbour plant is formed. The units are placed independently at a given distance apart in sideways direction and having a front surface along which a vessel is intended to be moored, forming passage(s) for parts of the waves, and being configured to dampen a part of the incoming waves while allowing other parts of the waves and current to pass through the harbour plant.

US 2005/139595 describes a plant storage and loading LNG, consisting of a seabed structure resting on a seabed, the seabed structure having a base slab resting on the seabed and three upwards extending walls. The seabed structure has an opening, allowing a floating module to be manoeuvred into position inside the seabed structure and ballasted to rest on the base slab.

FR 2894646 describes a gravity based structure resting on the seabed due to its own weight and provided with downwards projecting and open skirts, pressed down into the seabed. The gravity based structure has a U-shaped form, with vertical walls extending upwards from a submerged bottom slab, provided with buoyancy chamber, functioning as weight for providing the required weight. One embodiment of the gravity based structure may also be provided with piles extending downwards through the vertical walls and into the supporting soil, the piles being terminated at the top of the walls above sea level.

However, these harbour plants for storage can be large in scale, complex and expensive. They take a long time to build and they have limited variation with respect to mobility and other applications. Due to dependencies of deep skirts to enable foundation, problems may also be experienced during installation, in particular in shallow waters with muddy or soft seabed. In addition, the density, composition, consolidation and topography of seabed soil may vary significantly for one seabed location to another. For example, the soil in river mouths will often be dominated by soft, muddy soil with a kind of yoghurt texture, while other seabed areas may be influenced or overlapped by hard sandstone, limestone or ancient volcanic rock. This will have direct impact on the load bearing capacity of the seabed soil, and hence the possibility to find a predictable and reliable foundation solution for a seabed structure which shall be resting onto the seabed.

Hence, there exists a requirement for cost-effective, versatile and flexible harbour plant systems that can be installed in shallow waters and that is suitable for installation in areas with a sea bed having poor load carrying capacity. Moreover, there is a demand for an offshore plant which can be standardized as far as possible for fabrication and cost reasons, and which can easily be deployed in offshore or near shore locations with any type of seabed soil.

There is also a need for a method for securing proper and adequate piling of such harbour plant, avoiding relative movement between the plant and the sea bed during the piling operations.

SUMMARY OF THE INVENTION

The principle used according to the present invention is to use a piled base structure where the weight of a floatable body berthed in and supported by the base structure is transferred more or less directly down into the sea bed through piles terminated above the sea level, carried and/or secured by structures above the sea level. Moreover another principle used is to moor or anchor a floating body safely to a docking bay using gravitational force, and/or ballast. The floatable body or floating body may be exposed more or less fully to buoyancy by allowing a water-filled gap at least between bottom of the floating body and a corresponding upper surface of the base structure. The floating body may optionally be moored to the docking bay (or the base structure) in combination with tie in forces. In this respect the base structure may either rest on the seabed with at least a part of its foot print or the base structure may be positioned at a distance above the seabed soil, i.e. without really being in contact with the seabed soil, all loads, weights and forces in any case being taken and transferred into the seabed by the piles.

An object of the present invention is to provide a foundation and supporting system and an installation method for a base structure transferring the loads, forces and bending moments from a berthed floating structure (or floating body) directly into the deeper layers of sea bed soil without causing failure or instability of the support or the berthing foundation due to the environmental or other relevant forces acting on the base structure.

Another object of the present invention is to provide a multipurpose shallow water seabed terminal with a berthed floatable storage body and a method for establishing fixture between the floating body and a base structure.

Yet another object of the invention is to provide a seabed terminal that is designed for transferring significantly large vertical loads onto the seabed soil, caused by large weights of liquids stored inside a berthed body (i.e., the floatable body that is berthed) and/or forces and loads acting on the seabed terminal without allowing any relative motions between the floating body and the supporting structure and any relative motions between the seabed and the terminal.

A further object of the present invention is to provide a shallow water seabed terminal which is flexible in use, cost effective and easy to establish in most types of seabed soil conditions.

Another object of the invention is to provide a near shore storage system which may, when required, also be located in extremely soft and muddy soil as found in river deltas and seabed areas of unconsolidated soil where gravity based structures cannot be installed or will be prohibitively expensive and where the floating body without too complicated efforts may be removed again upon completed mission.

An additional object of the invention is that it may be given the structural capacity to resist large buoyancy uplift forces during extreme storm surges without any major volumetric modifications of its loading bearing structure.

It is also an object of the invention to directly secure safe transfer and/or distribution of large vertical loads and forces from the floating body to base structure and from the base structure to the piles and from the piles into the seabed, generated by storing large volumes of liquids within the floating body and/or generated by loads and forces generated by the sea state and weather.

It is also an object of the present invention to provide a seabed terminal comprising a seabed substructure and a floatable modular body specially designed to adapt to each other, and to simplify the berthing and mooring of the floatable body in a time and cost effective way.

It is also an object of the invention to provide a quick, safe and releasable installation and berthing of the floating body with topside equipment.

Yet another object of the present invention is to avoid local failure of one or more piles due to local excessive load impact caused by the assembled base structure and floating structure, the acting loads and forces being balanced out and distributed also to the neighbouring piles.

Yet another object of the present invention is to provide a mooring system based on a piling system where the acting loads and forces caused by environmental forces acting on the assembled structure or the loads and forces imposed by the floating structure on to the base structure are distributed through the interfaces between the floating structure and the base structure and between the base structure and the piling system in a controlled manner, avoiding excessive stresses and strains in the respective interfaces and avoiding ground failure in the interface between the piles and the surrounding sea bed soil.

Another object of the present invention is to provide a solution where it is possible to vertically level the position of the floating structure with respect to the base structure and/or locally adjust the vertical position of the floating structure in order to secure a balanced load and/or force distribution of acting loads and forces through the system.

Yet another object of the present invention is to provide a load and force transferring system where a balanced load and force distribution is established, securing that loads and forces are transferred through the base structure into the piles in manner avoiding excessive local stress and strain overload.

Another object of the present invention is to provide a seabed terminal or a harbour or a harbour plant with a shielding for a vessel, that may advantageously be more cost effective than employing a wave breaking structure, which may be relatively expensive.

The objects of the present invention are achieved by a seabed terminal and a method for establishing such seabed terminal as further defined by the independent claims. Embodiments, alternatives and variants of the invention are defined by the dependent claims.

According to an embodiment, a method for mooring a floating body in a harbour plant is provided. The harbour plant may include a piled base structure provided with two side walls projecting upwards through the sea level, terminated above sea level and a laterally arranged bottom structure rigidly interconnecting the side walls. The two sidewalls may be two opposing side walls facing each other.

In other words, the base structure may be arranged to be supported by a sea bed by means of a number of piles. For example, the piles may be terminated at a top surface of the side walls, above the sea level. In the context of various embodiments, the floating body may refer to a floating structure or a floater or a floating module.

A top surface of the bottom structure is arranged at a depth allowing the floating body to be floated in between the two side walls. Moreover, the floating body is arranged to be rigidly, but releasably supported by at least parts of the side walls. The floating body is floated into a position between the side walls and fixed rigidly to the vertical side walls of the base structure and still being exposed to more or less fully to buoyancy by allowing a water-filled gap at least between bottom of the floating body and a corresponding upper surface of the base structure, preventing relative vertical motion between the floating body and the base structure.

The floating body may as an option be rigidly fixed to the base structure by arranging a number of tensioning devices between the floating body and the upper part (or upper end or top part or top end) of the side walls, the tensioning devices being rigidly fixed with one end to strongpoints on the floating body and the opposite ends being rigidly fixed to the upper end of the side walls.

For example, the tension rods apply additional forces that combined with gravity and ballast increase the capacity of the fixation to take variations of vertical loads.

According to the invention, a surface on the floating body may be allowed to rest on a surface on the upper end surface (or top surface) of the side walls in close association with the upper end of piles supporting the base structure on the sea bed and extending vertically down through the side walls and into the sea bed.

The floating body may be provided with strongpoints on a part projecting sideway out from the sides of the floating body and the strongpoints of the floating body may be positioned above (or over) the top (or top surface or top part) of the side walls of the base structure, when the floating body is allowed to be floated in between the two side walls. The top surface of the side walls may be provided with correspondingly arranged complementary strongpoints configured to carry at least a part of the weight of the floating body.

The strongpoint on the side walls may preferably be formed by the top end of piles serving as a foundation for the base structure, allowing transfer of the weight from the supported floating body directly through the piles into sea bed. The top end of the piles may refer to an end region (or end part) of the piles where, for example, the piles may be terminated at the top surface of the side walls. It should be appreciated and understood that the piles need not necessarily terminate at the top surface of the side walls. In other words, the piles may be terminated anywhere along a pile sleeve.

A part of the weight of the floating body may preferably be compensated by means of buoyancy and in case of increase in sea water level, ballast water may be added and/or where increase of uplifting forces is taken by the tension devices.

Dampening devices may be arranged on the top surface of the side walls, configured to serve as shock absorbers during mating of the floating body on the base structure, securing a controlled transfer of loads and forces to the base structure, and possibly also securing distribution of the loads and forces in a manner preventing overloading a part of the base structure and/or the adjacent pile(s) below.

According to another embodiment of the invention, jacks may be arranged between the respective strongpoints on top of the side walls and the corresponding strongpoints on the floating body, allowing lifting of the floating body in order to achieve optimal weight and/or buoyancy balance between the two structures and between the mated structures on the one hand and the piled interface to the sea bed on the other hand.

The tensioning devices may be rigidly fixed with distal ends to strongpoints on the floating body and the opposite ends being rigidly fixed to strongpoints at the upper end of the side walls. More specifically, the tension in the tension devices can be adjusted in order to secure sufficient supporting and fixing force, one end of each being fixed to a strongpoint on the top surface of the sidewalls and the other end being fixed to the floating body.

The present invention also relates to a harbour plant for mooring of a floating body as set out above, where the vertical sidewalls are configured to carry the weight of the floating body through a rigid, but releasable fixture and still allow the floating structure to be more or less exposed to buoyancy due to a water filled gap at least between bottom of the floating body and with a corresponding upper surface of the base structure, and by a number of tensioned devices arranged between the floating body and the top of the side walls, preventing relative vertical motion between the floating body and the base structure.

According to one embodiment, strongpoints on the floating body may be arranged on a vertical surface projecting sideway out from the sides of the floating body and these strongpoints on the floating body may be arranged/positioned above the top of the side walls of the base structure, the top surface of the side walls being provided with correspondingly arranged complementary strongpoints configured to carry at least a part of the weight of the floating body.

Strongpoints on the side walls may be formed by the top end of piles, serving as a foundation for the base structure, allowing the weight from the supported floating body to be transferred directly through the piles into sea bed.

Jacks may be arranged between the strongpoints on top of the side walls and below the bottom of the strongpoints projecting sideways out from the floating body to adjust the tension in the tensioning devices.

Moreover, the tensioning device may be provided with a device for adjusting the tension in order to secure sufficient supporting and fixing force.

The strongpoints on the top surface of the side walls correspond to or are in close association with the upper end of piles supporting the base structure and extending through the side walls and into the sea bed.

The wall structure may form an integrated part of the base structure, forming a seabed substructure unit and may be provided with means for ballasting. At least parts of the wall structure extend above the water surface.

According to the present invention a shallow water base structure for example for storing and loading or unloading hydrocarbons, such as LNG, oil or gas is provided, comprising a floatable, seabed substructure intended to be supported by a seabed, the seabed substructure preferably comprising a base structure provided with an upwards extending wall structure, arranged along at least a part of the periphery of the base structure, the base structure preferably also being provided with an opening in the wall structure for allowing the floatable body to be berthed, moored and supported by the seabed substructure. The base structure is provided with strong points configured to receive corresponding strongpoints on the floating body and preferably also separate strongpoints for being connected to the ends of preinstalled vertical piles for at least temporary support of the base structure during a piling operation for permanent piling of the base structure to the sea bed.

The strong points may be arranged on top of the side walls above the sea level.

The strong points may be positioned at different positions along the exterior of the side walls. In yet other embodiments, the strong points may be arranged anywhere on the base structure such that the strong points are configured to receive corresponding strongpoints on the floating body and preferably arranged to be connected to the ends of preinstalled vertical piles for at least temporary support of the base structure during a piling operation for permanent piling of the base structure to the sea bed.

It should be appreciated that the strongpoints on the floating body may be arranged at positions that allow arrangement/positioning over the strong points of the base structure.

According to an embodiment the wall structure may form an integrated part of the base structure and the strong points form an integrated part of the wall structure.

The strong points may alternatively be positioned below the sea level either on the side walls or on the bottom surface of the base structure. In such latter case the piles may form a permanent part of the piling system.

The base structure is piled to the sea bed using a number of permanent piles driven into the seabed, the top of the piles being rigidly fixed to the base structure along the height of the side walls.

The seabed substructure comprises a base structure provided with buoyancy devices and an upward extending wall structure also provided with buoyancy devices. The wall structure is arranged along at least a part of the periphery of the base structure and comprises at least one opening in the wall structure for introducing a floatable storage module. The floatable module is removable arranged on top of the base structure within the wall structure, together forming an offshore unit supported by the seabed at least by means of piling.

According to a preferred embodiment of the invention, the wall structure of the base forms an integrated part of the base structure forming a seawater substructure unit. Moreover, the cantilever, beam or slab arranged at the top of the side walls form an integral part of the wall structure and is designed and dimensioned to withstand all temporary loads forces and moments occurring during the piling process. For this purpose the cantilever, beam or slab may be provided with strong points to co-function with temporarily purpose installed piles.

It should be appreciated that the floating body base may be provided with ballast tanks and pumping system, using water to adjust weight and buoyancy and the vertical forces and load exposures acting on the system during operation.

The wall structure of the seabed substructure is terminated above sea level. Some of the advantages of having part of the seabed substructure above water, as shown in the drawings, are:

a) The water plane facilitates and reduces uncertainty around stability during installation of the seabed substructure.

b) The part of seabed structure will facilitate and simplify the float-in and installation of the storage module.

c) Piling machinery may be placed on the base structure above water level, which reduces cost and time, becoming independent of sea conditions during piling.

d) The seabed substructure above water level will represent an added protection against ship collision.

e) Some equipment, e.g. cargo loading arms may in some cases be installed onto the seabed substructure and hence at some distance from the floating body.

By providing a quay side with outwards projecting beam or slab it is possible to berth a vessel at a distance from the vertical wall, enhancing manoeuvring and mooring the vessel along the quay side.

In addition, this feature of the present invention is also very useful when installed in shallow cyclone and storm surge exposed areas, where water levels in extreme 100 years cases may rise as much as 8-9 meter above normal sea level. For such cases tension rods arranged between the base structure and the floating body may take a large portion, if not all, of the uplift buoyancy forces, while other parts of these extreme, temporary uplift forces may be counteracted by active water ballasting of the storage module.

The seabed unit of the seabed terminal may be designed to take very large vertical loads onto the seabed from large weights of liquids stored inside the storage module without any motions of the seabed terminal, typically up to, but not limited to 150,000 tonnes deadweight, corresponding to the capacity of a large tanker ship. Some of this capacity may be obtained by increasing the height of the storage volume while maintaining the horizontal footprint of the seabed terminal.

BRIEF DESCRIPTION OF THE DRAWINGS

In the drawings, like reference characters generally refer to like parts throughout the different views. The drawings are not necessarily to scale, emphasis instead generally being placed upon illustrating the principles of the invention. The detailed description will be better understood in conjunction with the accompanying drawings, where the drawings and description merely relate to preferred embodiments, as follows.

DETAILED DESCRIPTION OF THE EMBODIMENTS

The following description of the exemplary embodiment refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a method for installation of a base structure on a seabed in general and preferably, but not necessarily on a sloped seabed and/or on a seabed with a low bearing capacity.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

The key area for the invention is to provide a quick and safe installation of the storage module with topside equipment where the base structure is stably and rigidly supported during the piling operation of the permanent piles. By having a pre-installed base foundation, which is stabilized at least by means of piles and levelled in advance to the seabed, then the installation of the storage module can take place within a few hours.

In addition, the present invention offers the possibility of establishing a seabed terminal on different soil conditions. The density, composition, consolidation and topography of seabed soil may vary significantly for one seabed location to another. This will have direct impact on the load bearing capacity of the seabed soil, and hence the possibility to find a predictable and reliable foundation solution for a seabed structure which shall be supported by the seabed. According to one embodiment, the based foundation may be in the form of a semi-submersible floating body, piled to the seabed. In this case the base substructure can be ballasted as a semi submersible structure and piled to the seabed through the base structure and possibly, but not necessary, the wall structure of the seabed substructure. It is important in these cases to have an efficient transfer of vertical structural forces, it is an advantage that the main structural beams of the base structure and the storage module has mirrored structural interfaces. This means that vertical forces from the bulkheads of the storage module are preferably transferred directly into the main structural beams of the base structure and into the piling structure and to the seabed. Calculations have shown that the piled seabed substructure must tolerate and stand a weight of 100 000-120 000 tons.

Figure 1:
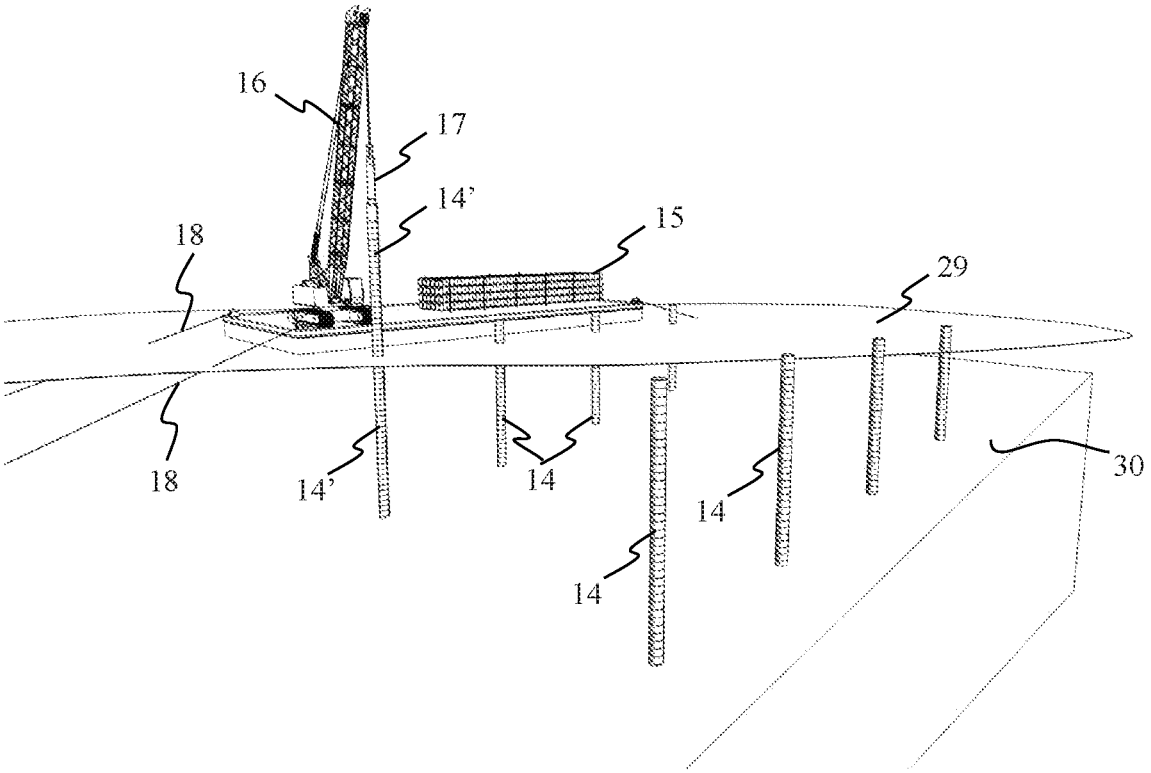
FIG. 1 shows schematically a view in perspective, showing piling of an intermediate set of piles to support a base structure during installation and permanent piling operation.

FIG. 1 shows schematically a first stage of the installation procedure, where two rows of aligned piles 14 spaced apart are arranged, the last pile in the row 14' being in process of being forced into the seabed 30 by means of a piling barge 15 with a crane 16 and a pile driving tool 17 suspended from the crane 16. During this stage the flat top barge 15 may be moored by means of conventional seabed anchors (not shown) and mooring lines 18 (two of which being shown). As indicated in the Figure the piles 14 are terminated at a predefined height above the sea level 29.

Figure 2:
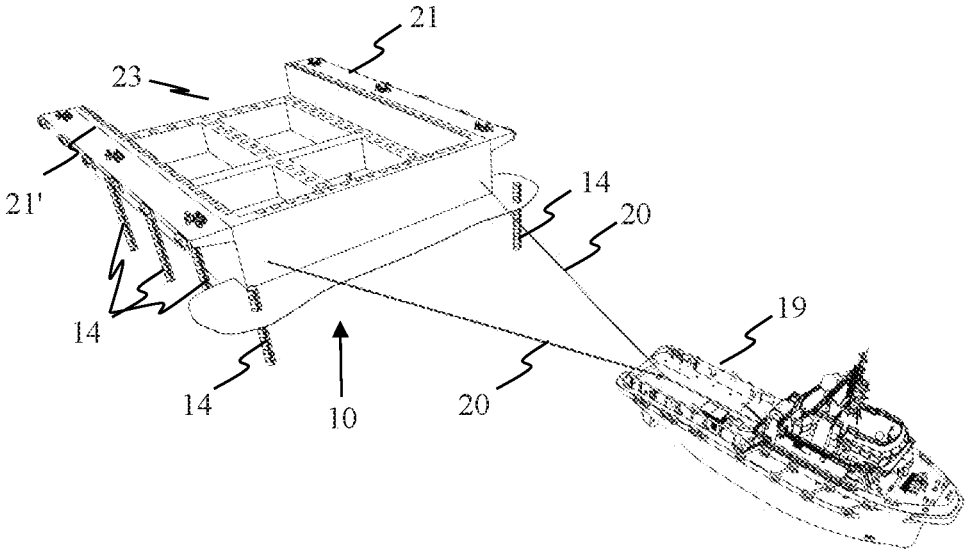
FIG. 2 shows schematically and in perspective a base structure in the mobilizing phase of being manoeuvred in over the intermediate piles.

FIG. 2 shows schematically a base structure 10 being towed into position between the two rows of aligned piles 14 by a towing vessel 19 and a pair of towing lines 20. The base structure 10 comprises two vertically arranged side walls 22, rigidly fixed to an intermediately arranged bottom structure, forming a dock structure with a U-shape, configured for berthing or docking a floating body 11. At the top of the vertically extending sidewalls 22, each side wall 22 is provided with an outwards projecting cantilever 21, 21' extending outwards on each side of the base structure 10, extending laterally out from the top of the base structure 10 entirely along the two parallel side walls 22, each cantilever 21, 21' being configured to rest on top of a corresponding row of piles 14. For such purpose the cantilevers 21, 21' are provided with strong points 24 (not shown in FIG. 2), dimensioned and configured to transfer the weight of the base structure 10 temporarily and possible also carrying temporarily appearing loads, forces and bending moments introduced at least during the installation stage of the base structure 10 until the base structure is safely piled to the seabed 30.

The base structure 10 is provided with a system (not shown) for ballasting and is preferably made from steel, although other materials can also be used, such as concrete. It should be appreciated that the base structure 10 according to the present invention may also be provided with auxiliary devices and systems, such as loading systems, cranes, winches, etc., arranged permanently or temporarily on top of the base structure 10. When a floating body or module 11 arrives at the site, it is manoeuvred in a floating state in between the two upwardly extending side walls 22. During this mating operation, the floating body 11 is manoeuvred in through the opening 23 at one end of the base structure 10 and in between the two parallel upwards extending side wall structures 22. The floating body 11 is guided in a way such that strongpoints on the floating body 11 are brought into vertical alignment with corresponding strongpoints arranged on the top surface of the side walls 22. Such strongpoints on the top surface of the two vertical walls 22 correspond with the top end of the piles 25, ended substantially at the top surface of the vertical walls 22. The floating module is then ballasted so that it rests stably on the upper end of the vertical walls 22 of the base structure 10. At sites where changes in sea water level are significant (or at challenging sites), compensation (e.g., by using ballast water, or active ballast) may be required. However, at sites where changes in sea water level are not significant, there may not be a need for compensation by, e.g., using ballast water, and the floating module may still rest stably on the upper end of the vertical walls 22 of the base structure 10. In any case, it should be appreciated that there should be a clearance between the upper surface of the interconnecting structure (base structure) and the bottom surface of the floating body 11. In other words, the upper surface of the interconnecting structure and the bottom surface of the floating body 11 are not in direct contact with each other.

Figure 3:
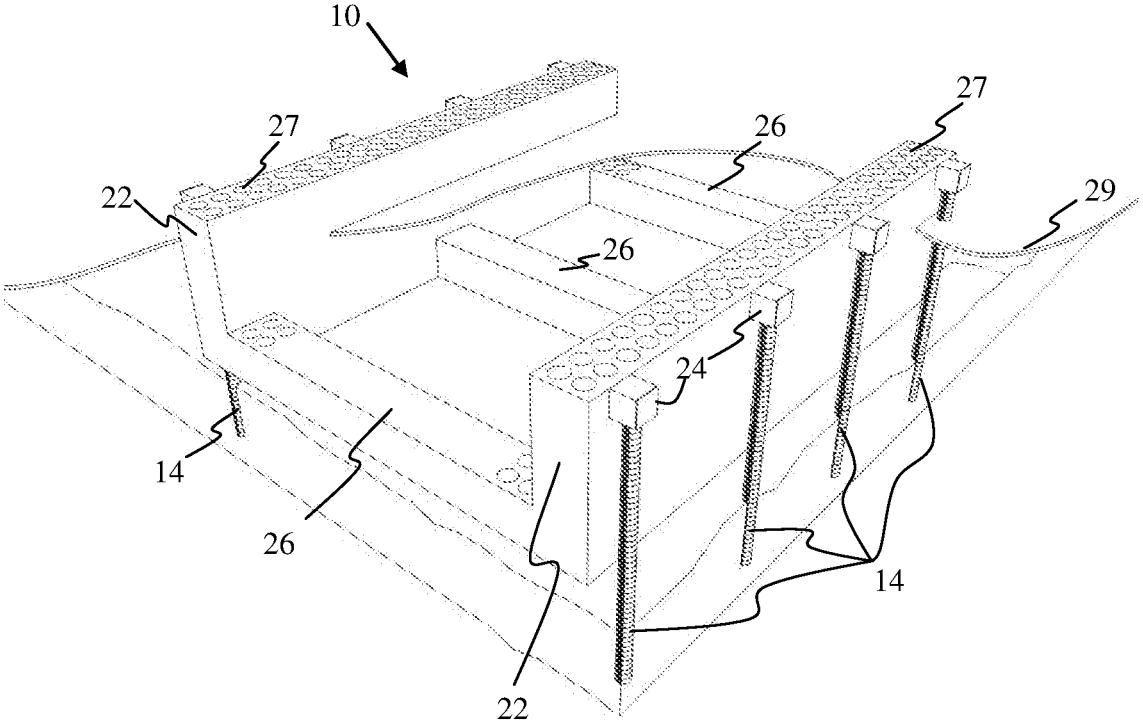
FIG. 3 shows schematically and in perspective the base structure installed and supported by the intermediate set of piles.

FIG. 3 shows schematically and in perspective an embodiment of the base structure 10, the base structure 10 being installed on top of and being and supported by the set of intermediate piles 14. As shown the temporary piles 14 are aligned with the strongpoints 24 projecting sideways out from the outer, upper part of the side walls 22. The base structure 10 comprises two vertically arranged walls 22 interconnected at the lower end by means of three horizontally arranged box beams 26, rigidly fixed to the side walls 22. Moreover, as indicated the base structure 10 is intended to be piled to the sea bed 30 by means of two rows of piles 14. For such purpose the vertical walls 22 are provided with two rows of casings 27 serving as guiding means to enabling piling operations to be performed above sea level 29, through the casings 27 in the vertical walls 22 and into the sea bed soil. According to the installation stage shown in FIG. 3, the permanent piling process has not yet been initiated. As further indicted, also the box beams 26 may be provided with casings 27 if required in order to obtain appropriate fixture of the base structure to the sea bed 30.

Figure 4:
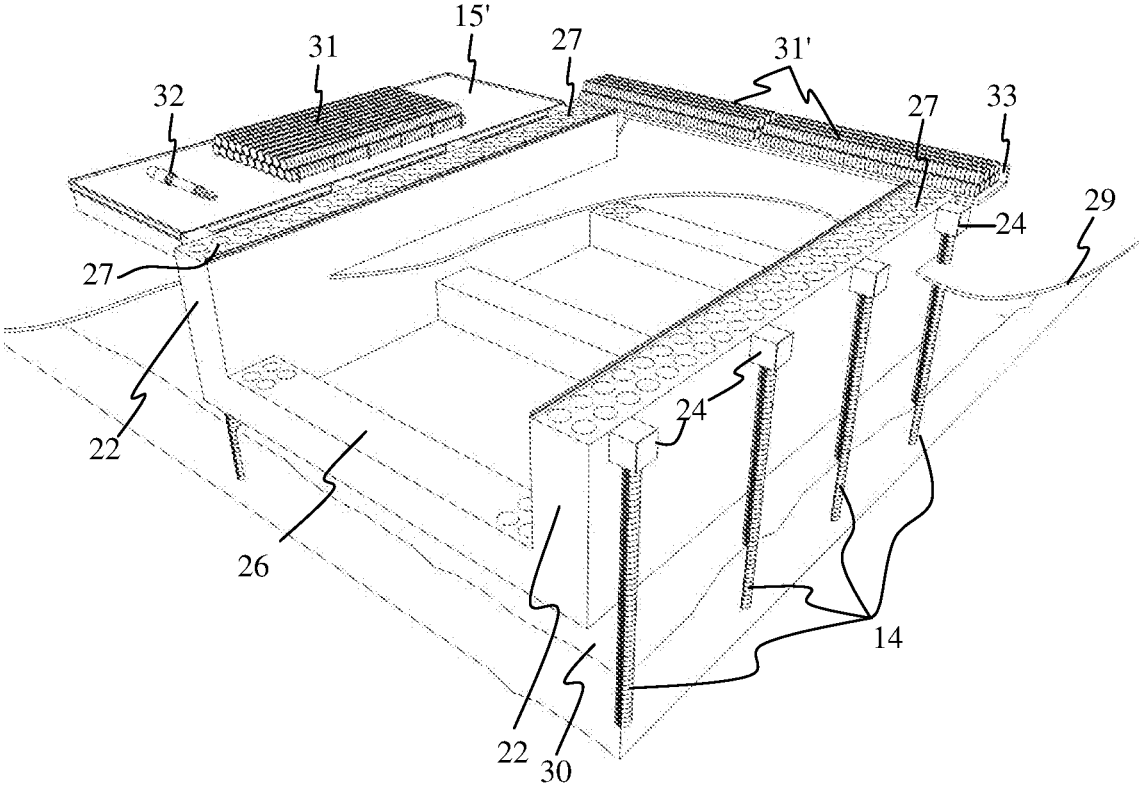
FIG. 4 shows schematically and in perspective a mobilizing phase where a working barge is moored along one side of the base structure and with an additional stock of piles.

FIG. 4 shows schematically and in perspective a mobilizing phase of the piling operation where a working barge 15' is moored alongside the outer side of a vertical wall structure 22. On the deck of the flat top barge 15' a stock 31 of piles to be piled is stored. In addition a hydraulic hammer 32 is indicated. Across the two vertical side walls 22, at one end of the base structure a temporary installed platform 33 is arranged storing yet another stock 31' of piles to be piled.

Figure 5:
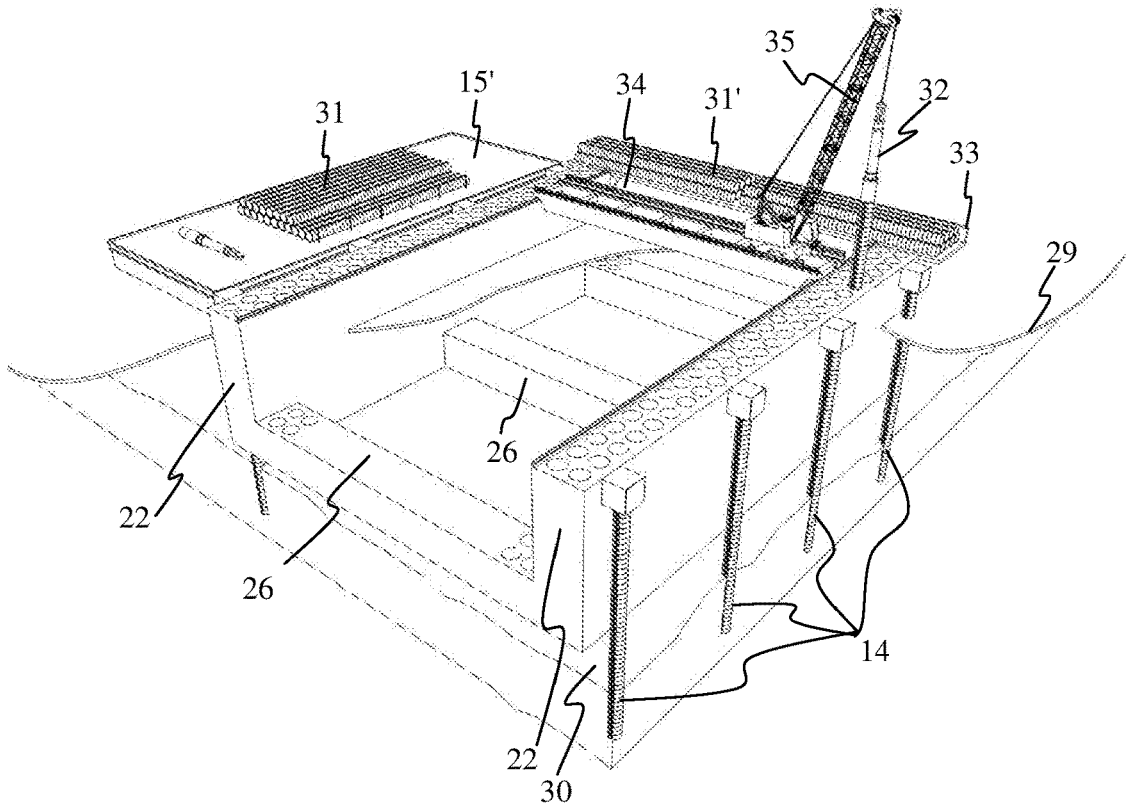
FIG. 5 shows schematically and in perspective a view of the base structure during the piling phase of the permanent piles.

FIG. 5 shows schematically and in perspective a view of the base structure during a mobilization phase of the piling operation of the permanent piles 25 where a gantry platform 34. Each end of the gantry platform 34 runs on rails (not shown) arranged along each of the side walls 22, enabling the gantry platform to run along the length of the base structure 10. A crawler crane 35 is arranged on the gantry platform 34, the crawler crane 35 being configured to move back and forth on the gantry platform 34 to collect piles 25 from the stock of piles 31, 31' and to install the piles 25 through the casings 27 by means of the hydraulic hammer 32. As indicated the hydraulic hammer 32 and a permanent pile 25 is suspended from the hook of the crawler crane 35, the pile 25 being in the process of being piled through the corresponding casing 27 through the side wall 22.

Moreover, a railed welding station (not shown), running on a pair of rails (not shown) on each of the top sides of the side walls 22 may also be used for welding works related to fixing of the completed pile configuration.

The base structure 10 may also be provided with a fender system (not shown) and a mooring and winching system (not shown) for mooring vessels at least along one side of the base structure 10.

Figure 6:
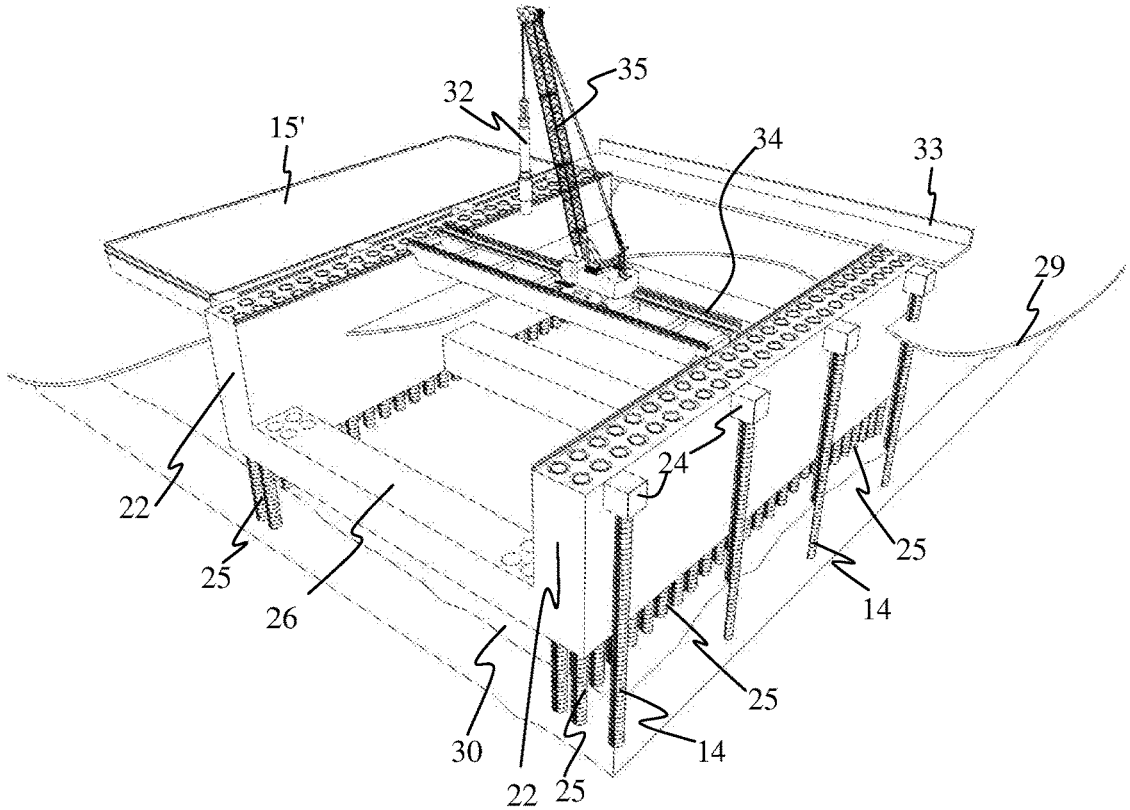
FIG. 6 shows schematically the de-mobilizing stage where the piling of the permanent piles has been completed.

FIG. 6 shows schematically the de-mobilizing stage where the piling operation of the permanent piles 25 is completed, but prior to de-mobilizing the gantry platform 34 and crawler crane 35; the flat top barge 15'; and the additional storage platform 33.

Figure 7:
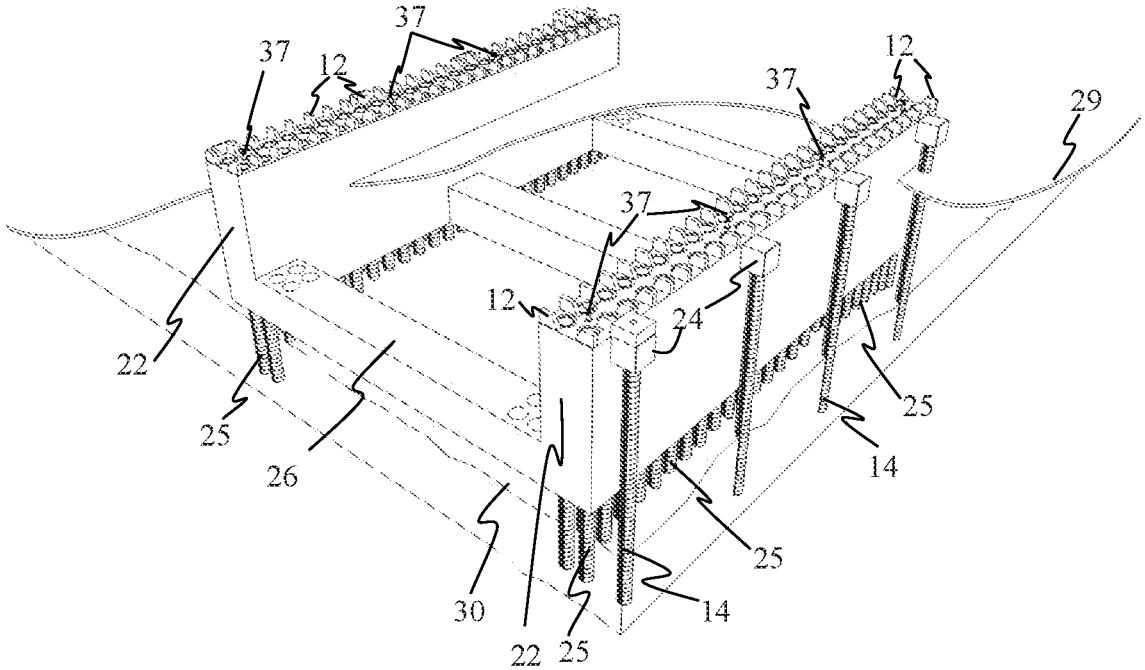
FIG. 7 shows schematically and in perspective the base structure in its permanently piled position supported by the seabed by means of piles.

FIG. 7 shows schematically and in perspective the base structure 10 in its permanently piled position supported by the seabed 30 by means of piles 25. The piles 25 are terminated at the top of the upper surface of the side walls 22. As indicated upwards projecting ribs or fins 12 are arranged on each side of each pile, servings as support for the floating body 11 on the base structure 10. Moreover, in the space on the top surface of the upper walls a number of dampers 37 may be arranged. The fins or load transferring plates 12 are configured to take the loads and forces from the floating body 11 and transfer said loads and forces down and into the pile 25 immediately below and possibly into the neighbouring piles 25. For such purpose the side wall structure is configured and constructed in such way that the forces are transferred from the side wall 22 and into the pile(s) in a controlled and intended manner. The loads and forces may be transferred directly into the top end of a pile by direct vertical transfer arrangement and/or into the pile wall along the more or less entire interfacing length between the side wall 22 and the corresponding part of the pile 25.

Figure 8:
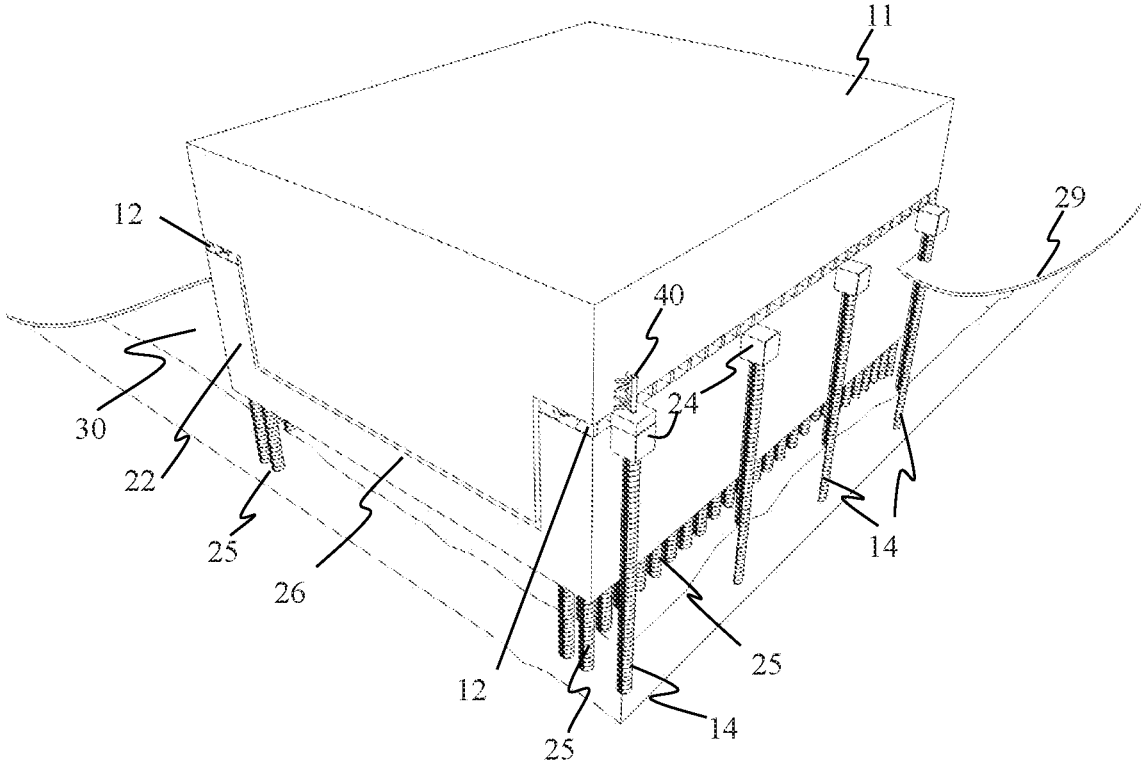
FIG. 8 shows schematically and in perspective a stage where a floater is floated in and supported by the base structure.

FIG. 8 shows schematically and in perspective a stage where a floating body 11 is manoeuvred in a floating state between the vertical side walls 22 of the base structure 10 to a position where strong points (not shown) on the bottom surface of the floating body are vertically aligned with the corresponding strongpoints on the upper surface of the side walls 22, whereupon the floating body 11 is lowered down until it rests on and is supported by the vertical walls 22. It should be appreciated that the floating body 11 is not limited to the shape or configuration shown, but may be varied without leaving the inventive idea.

Figure 18A:
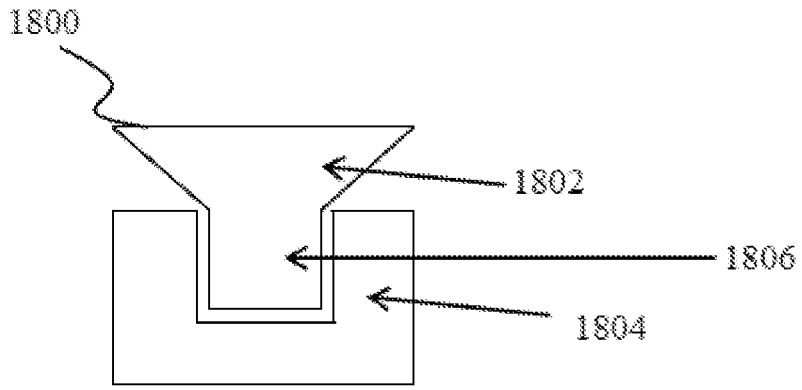
FIG. 18A shows a cross-sectional side view of the floating module having an upper frustoconical portion and the base structure, in accordance with various embodiments.
Figure 18B:
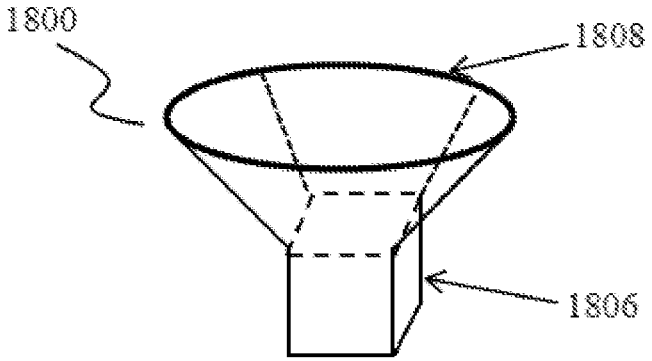
FIG. 18B shows a perspective view of the floating module of FIG. 18A having a circular top, in accordance with an embodiment.
Figure 18C:
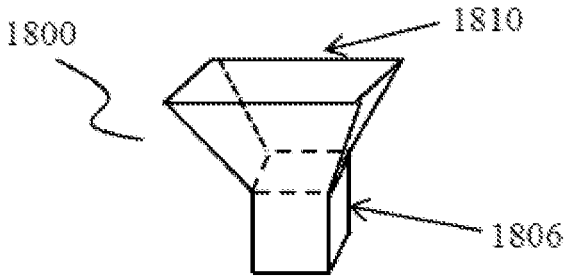
FIG. 18C shows a perspective view of the floating module of FIG. 18A having a square or rectangular top, in accordance with an embodiment.

For example, the floating body 11 may have a T-shape cross-sectional side view, and a square or rectangular top view (as seen in FIG. 8). Another example may include a floating body 1800 having an upper frustoconcial portion 1802 when seen from a cross-sectional side view, as illustrated in FIG. 18A. The upper frustoconcial portion 1802 may be supported by the top edge of the base structure 1804 (which may be described in similar context to the base structure 10). Such an exemplary floating body 1800 may have a circular top view 1808 (as seen in FIG. 18B); or a square or rectangular top view 1810 (as seen in FIG. 18C). The floating body 1800 may include a lower portion 1806 that is configured to be arranged between the two opposing side walls of the base structure 1804. The lower portion 1806 may be cylindrical. The lower portion 1806 may, for example, have a square or rectangular cross-sectional shape when seen from the top. It should be appreciated that the lower portion 1806 may have a different cross-sectional shape when seen from the top.

In order to allow the floating body 11 to be supported in an appropriate and adequate manner, the floating body 11 may be provided with a section projecting sideways out from the lower part of the floating body 11, said outwards projecting part having a lower surface provided with strongpoints (not shown) intended to be in vertical alignment and supporting contact with corresponding strongpoints on the upper surface of the side walls 22. Embodiments of such supporting contact will be described in further details below.

Figure 9:
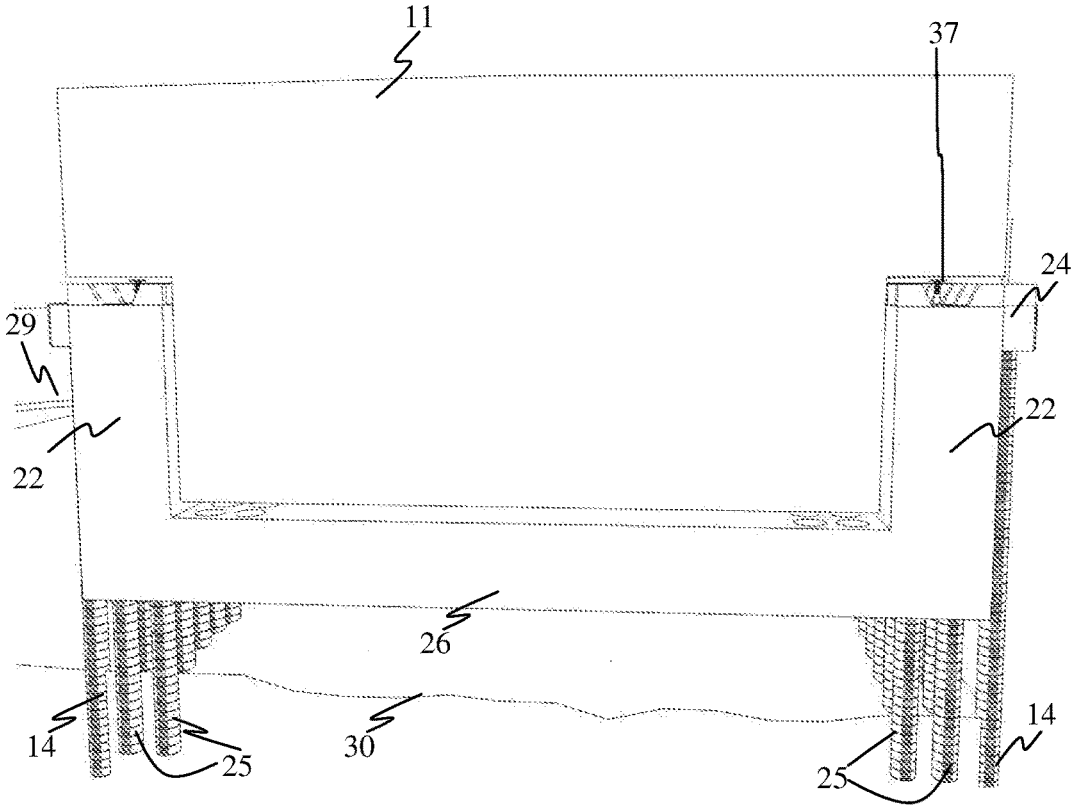
FIG. 9 shows schematically an end view of a base structure and a floating body docked in and supported by the base structure.

FIG. 9 shows schematically an end view of a base structure 10 and a floating body 11 docked in and supported by the vertical side walls 22 of the base structure 10. As indicated the floating body 11 is only supported by the base structure 10 along the upper surface of the vertical side walls 22, leaving a gap 38 between the floating body 11 and the base structure 10 at the bottom and along the inner surface of the vertical side walls 22. Moreover, according to the embodiment disclosed in FIG. 9 the bottom surface of the base structure 10 is positioned above the sea bed 30. It should be appreciated, however, that the base structure may rest partly or fully on the sea bed 30, if required.

Figure 10:
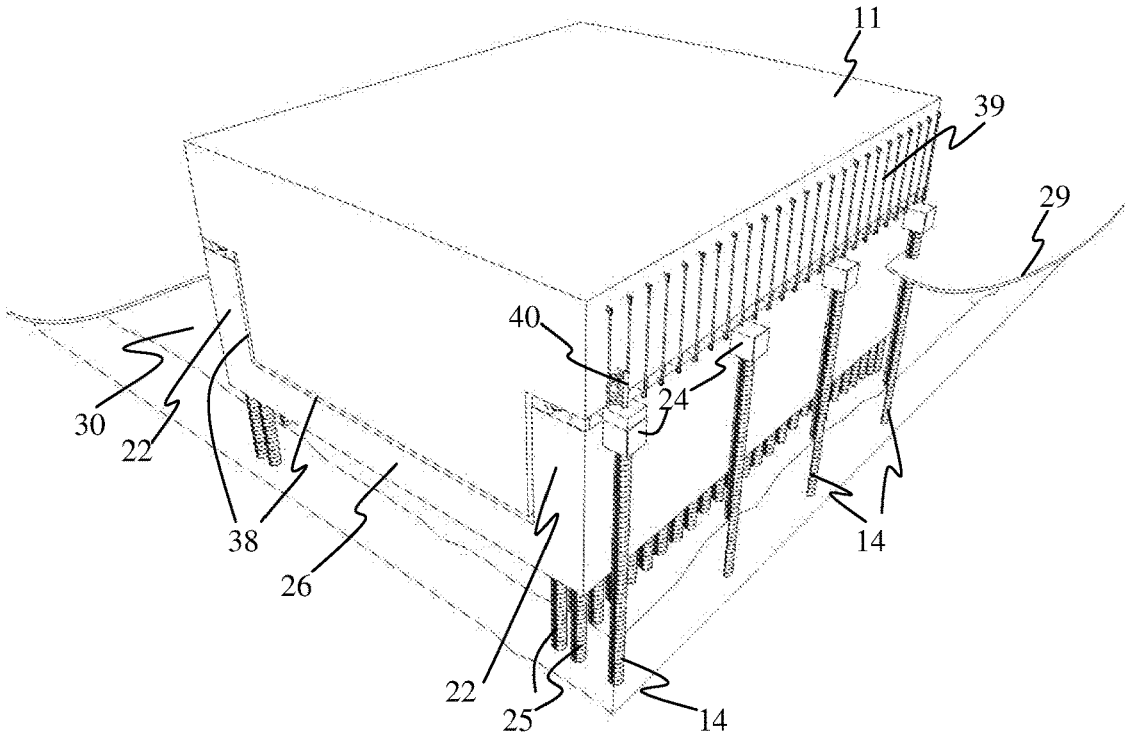
FIG. 10 shows schematically and in perspective the base structure and floating structure shown in FIG. 9, also indication use of tension rods for fixing the floating body to the base structure.

FIG. 10 shows schematically and in perspective the base structure 10 and floating body 11 shown in FIG. 9, also indicating use of tension rods 39 for fixing and/or tying the floating body 11 to the base structure 10. The purpose of the tension rods 39 is to tie the floating body 11 down into adequate and safe supporting contact with the base structure 10. Moreover, as indicated in the Figure, the floating body 11 and the base structure 10 may be provided with guiding devices 40, preferably arranged at least at two diagonally opposed corners, so as to secure proper alignment of the floating body 11 during the mating on the base structure 10. Details of the guiding device will be described in more details below.

Figure 11:
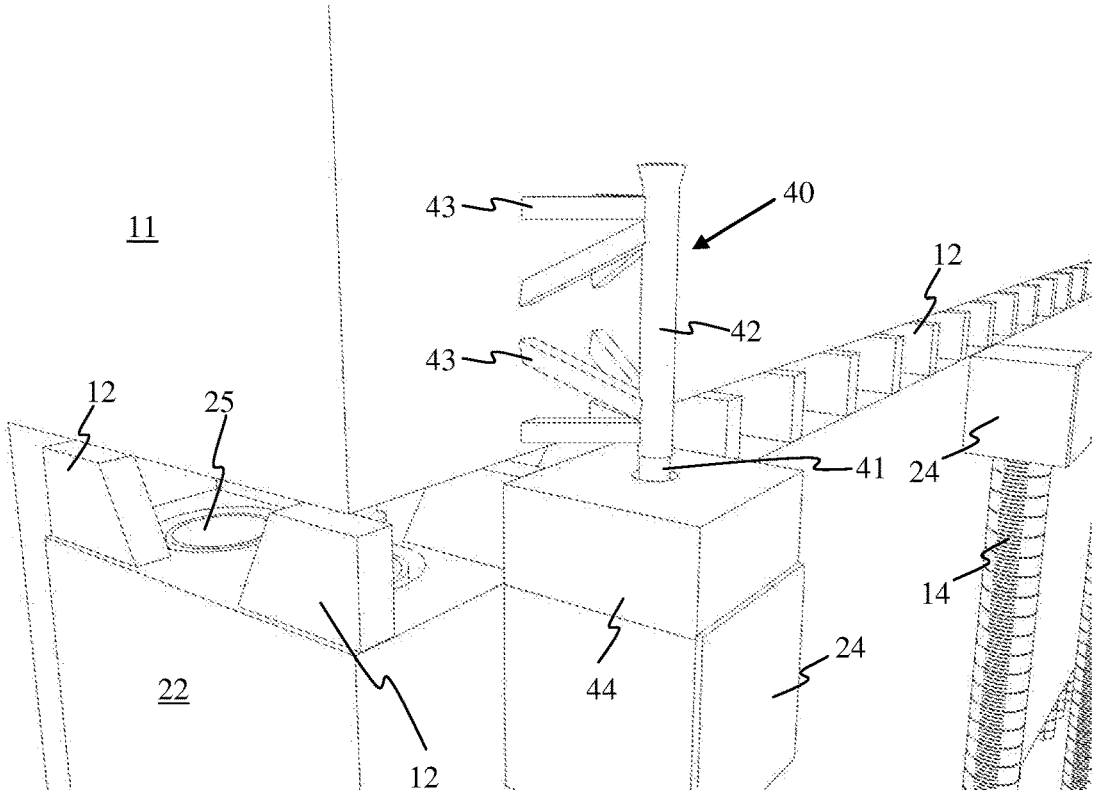
FIG. 11 shows schematically in enlarged scale an exemplary initial phase for using guiding pins, used for securing correct position of a floater in the dock.
Figure 12:
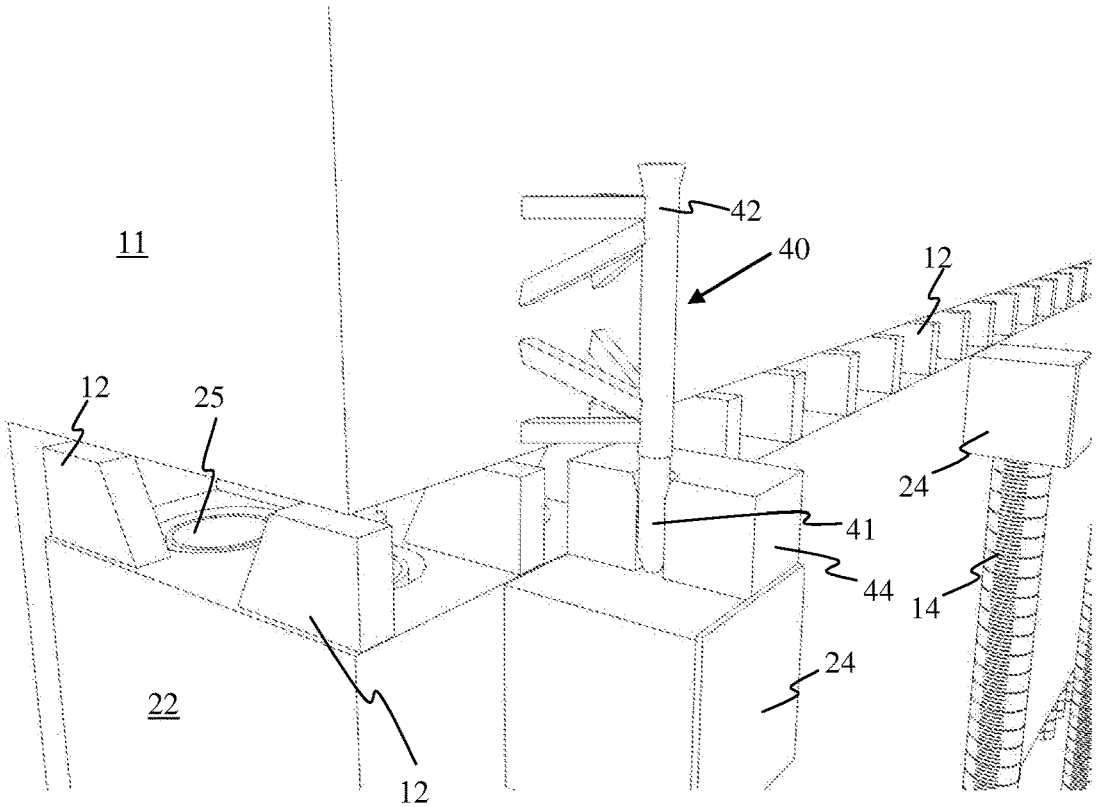
FIG. 12 shows schematically and in enlarged scale the exemplary guide pins in final position, the floater being in locked position supported by the dock.

FIGS. 11 and 12 show schematically in enlarged scale an exemplary initial and final phase of the use of the guiding device 40. The guiding device 40 comprises vertical pin 41 movably arranged in a vertical sleeve 42, rigidly fixed to the lower end of the floating body 11 by means of a structural frame element 43. On the top surface of the side wall 22 a corresponding seat 44 is provided, configured and dimensioned to receive the lower end of the vertically movable pin 41. The guiding device 40 is used for securing correct position of a floating body 11 to the base structure 10. When the floating structure 11 is brought into correct position floating above the upper surface of the side walls 22 and when the movable pin 41 or dowel is in alignment with its seat 44, the pin 41 or dowel is lowered down into the seat 44. With all pins 41 in seated position with respect to the seat 44 on the upper surface of the side walls 22, the floating body is in correct position and may be ballasted until supporting contact between the two is established. The final, accurate manoeuvring of the floating body 11 may be performed by towing vessels and/or a winching system (not shown).

Figure 13:
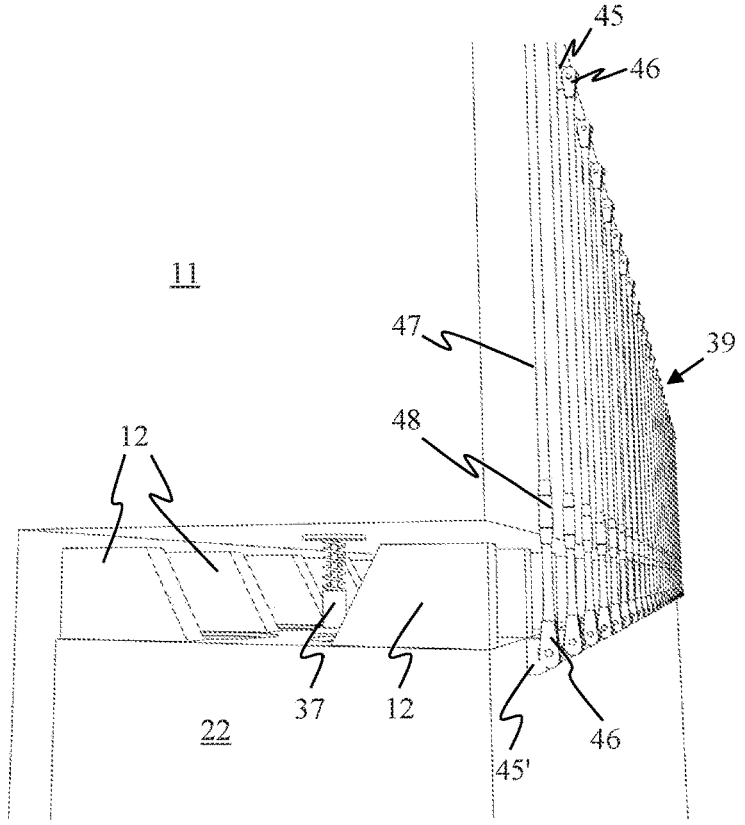
FIG. 13 shows schematically in enlarged scale a side view of a part of the top surface of the side wall and a corresponding complementary part of the bottom of the floating body.

FIG. 13 shows schematically in enlarged scale a side view of a part of the top surface of the side wall 22 and a corresponding complementary part of the bottom of the floating body 11. As indicated a number of tension rods 39 are arranged along more or less the entire length of the floater's 11 side surface and the upper end of the external side of the side walls 22. It should be appreciated that other embodiments may include the tension rods 39 being arranged differently (not shown in Figures) and nevertheless provide fixing of the floating body 11 and the side wall 22 to each other. For example, one end of each tension rod 39 may be arranged at any position along the length of the floater's 11 side surface (or the top surface of the floater 11) and the opposite end of the tension rod 39 may be arranged at any position along the external side of the side walls. However, distribution of the tension rod 39 over the substantially entire length may provide more rigid fixation. The number of tension rods 39 used may also vary.

At the upper end the tension rod 39 is rigidly fixed to the floating body 11 by means of a bracket 45 securely fixed to the sidewall of the floating body 11. Correspondingly, at the lower end the tension rod 39 is fixed to the outer surface of the side wall by a corresponding bracket 45', securely fixed to said wall. At both ends the tension rod 39 is provided with a socket 46, such as for example a standard open spelter socket termination, and intermediately arranged rod or wire 47, rigidly fixed to the socket 46.

The tension device may be a form of a connecting device or a connecting means.

In the context of various embodiments, other forms of the connecting device or connecting means may include the tension rod 39, a bolted connection, or a welded connection, or a clamping connection, or any combination thereof.

A turnbuckle 48 may be incorporated into each tension rod 39 in order to allow adjustment of the length of each individual tension rod 39 used, securing more or less equal tension in the tension rods and/or to control the tension when de-ballasting or ballasting the floating body 11, as the case may be.

FIG. 13 discloses also the strongpoints 12 arranged along the upper surface of the side walls 22. The strongpoints 12 are in the form of upwards extending fins or ribs arranged along both side of the side wall 22 and placed between each upper end of a pile 25 (not shown in the Figure).

Figure 14:
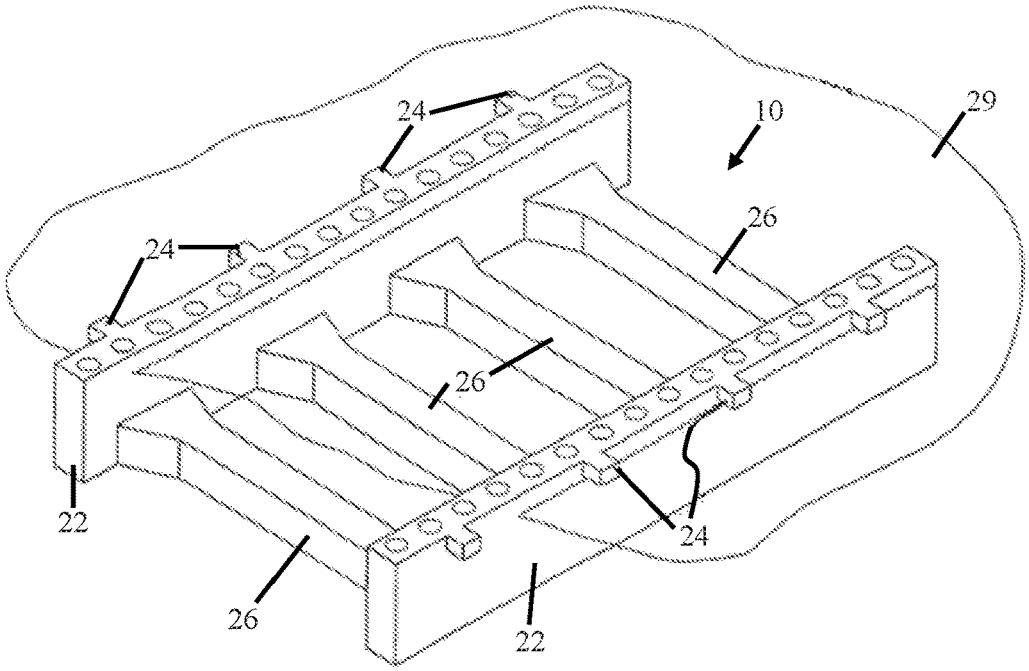
FIG. 14 shows schematically and in perspective a view of another embodiment of the base structure, in accordance with the present invention, where the base structure is opened for float in of a floater at two opposite ends.

FIG. 14 shows schematically and in perspective a view of another embodiment of the base structure 10, in accordance with the present invention, where the base structure 10 is opened for float-in of a floater 11 at two opposite ends. As shown, the base structure 10 comprises two parallel wall sections 22, arranged in spaced relation and interconnected by four laterally extending beams 26, fixing the lower ends of the walls 22 together, leaving open space between at the bottom surface of the base structure 10. According to the embodiment shown, only the vertical walls 22 extending up above the sea level when installed are provided with pile sleeves for receipt of the piles, allowing for dry piling above the sea level 29. In order to transfer forces appearing in the bottom section into the vertically extending side walls 22, the beams 26 may at each end be provided with an increasing larger vertical cross-sectional area towards the end of the beams and towards the corresponding inner side panel of the vertically extending side walls 22. At the upper end of the side walls 22, facing outwards, away from the side walls 22, the sidewalls are provided with strong points 24 to sit on pre-installed temporary piles (not shown). In principle the permanent piling is preferably performed only through the vertical walls 22.

Figure 15:
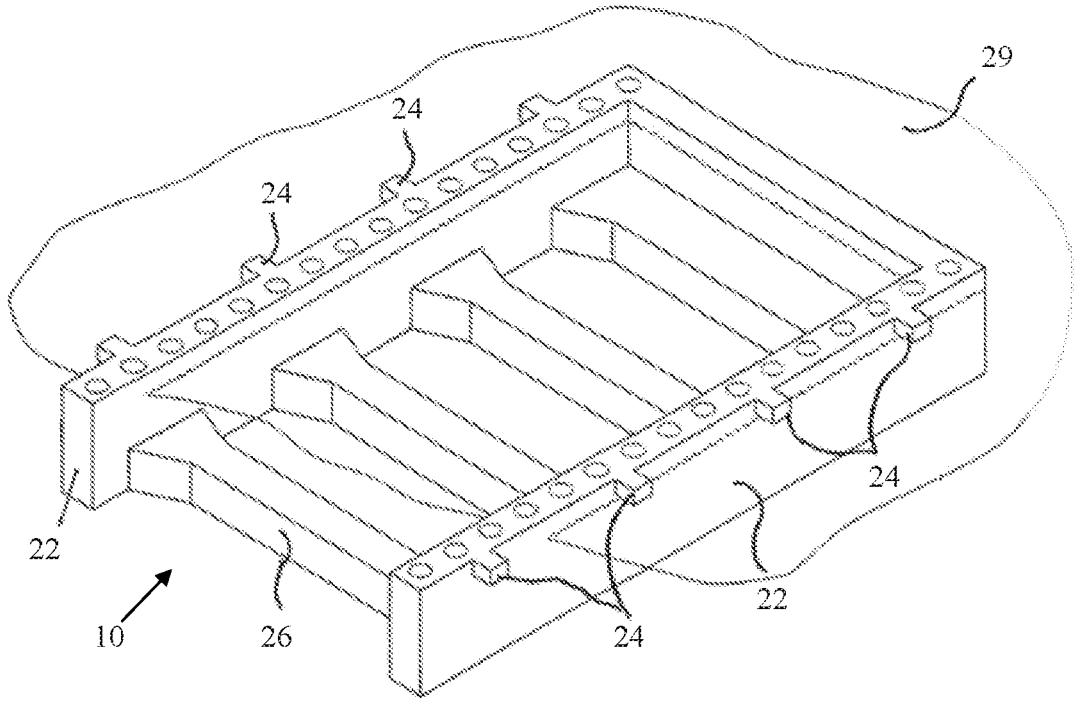
FIG. 15 shows schematically and in perspective a view of yet another embodiment of the base structure, in accordance with the present invention, where the base structure is provided with only one opening for float in of a floater.

FIG. 15 shows schematically and in perspective a view of yet another embodiment of the base structure 10, in accordance with the present invention, where the base structure 10 is provided with only one opening for float-in of a floater 11 (not shown in FIG. 15). Apart from the fact that the base structure is provided with an opening for float-in of a floater from one side only, the embodiment disclosed is similar to the one disclosed in FIG. 14.

Figure 19A:
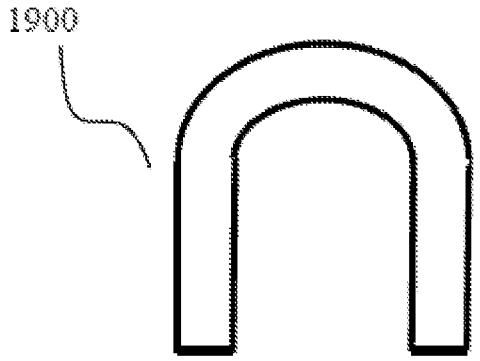
FIG. 19A shows a top view of the base structure having a U-shape, in accordance with an embodiment.
Figure 19B:
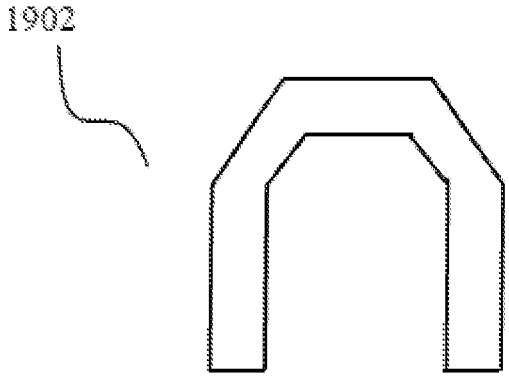
FIG. 19B shows a top view of the base structure having a shape of partial hexagonal, in accordance with an embodiment.

In FIG. 15, the base structure 10 has three adjacent side walls forming a substantially rectangular shape when seen from the top. It should be appreciated that adjacent side walls may form other different shapes when seen from the top. For example, in FIG. 19A, the side walls of the base structure 1900 (which may be described in similar context to the base structure 10) may form a U-shape when seen from the top. In yet another example 1902 as seen in FIG. 19B, the shape formed may be partial hexagonal. It should be appreciated and understood that regardless of the shape formed by the side walls, there is an opening or gap to allow the floating structure to berth within the base structure, between the two opposing side walls. The base structure having a single opening (i.e., having at least three adjacent side walls) may be beneficial for breaking waves. The side walls may not need to be a solid structure. For example, the side walls may include holes or apertures, or sleeves above the waterline.

Figure 16:
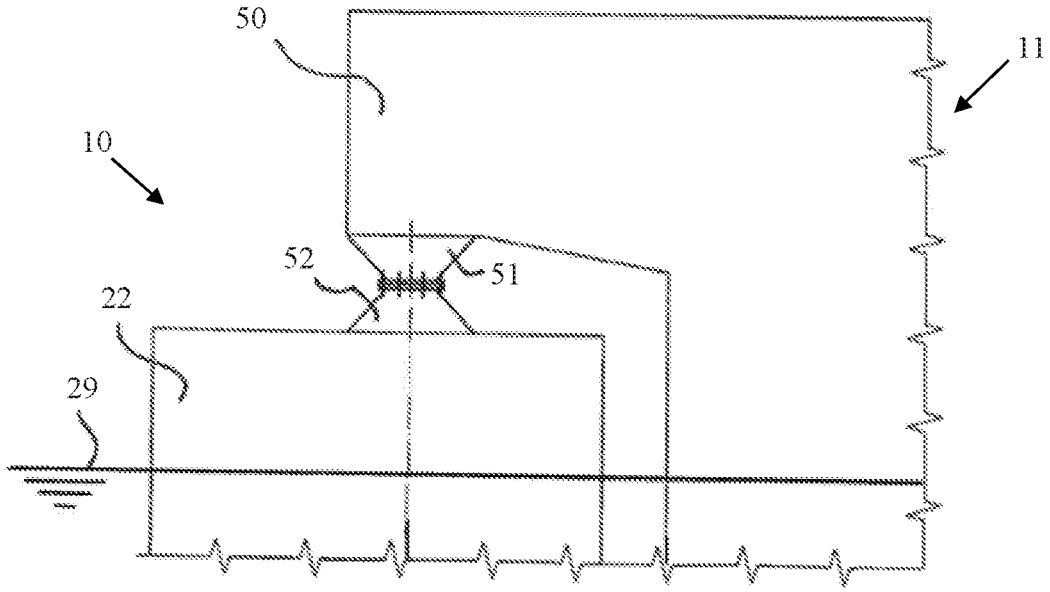
FIG. 16 shows schematically a side view of an alternative way of establishing a fixture between the floater and the top of the base structure.

FIG. 16 shows schematically an end view of an alternative way of establishing a fixture between the floater 11 and the top of the base structure 10 at the top surface of the vertically extending walls 22. As shown, the floater 11 is provided with a sideways projecting part, positioned above the side walls 22. The side wall 22 is provided with a sideways extending cantilevered section(s) 24 (not shown in FIG. 16, serving as strongpoints for support of the base structure during at least the installation phase, allowing the base structure 10 to rest on temporarily installed piles, prior to completing the permanent piling operations of the base structure 10. Moreover, the floater 11 is also provided with a cantilevered section 50, extending sideways out from the main body of the floater 11 above the sea level 29, the cantilevered section(s) 50 being configured to be rested on and be supported by the top surface of the vertical wall 22 on each side of the base structure 10. In order to secure a controlled transfer of loads and forces and in order to fix the floater 11 in a secure and safe manner to the base structure, brackets 51 are fixed to the interface surface on the cantilevered section(s) 50 on the floater 11, and corresponding, complementary brackets 52 are fixed to the supporting surface at the top of the walls 22. The two sets of brackets 51, 52 are bolted or fixed or welded together. It should be appreciated that the cantilevered section 50 may be a section extending along the entire length of the side of the floater, or as separate cantilevered units, placed apart in spaced relation along each side of the floater 11. As shown there is a certain spacing between the inner surface of the side wall 22 of the base structure 10 and the side wall of the floater 11.

Figure 17:
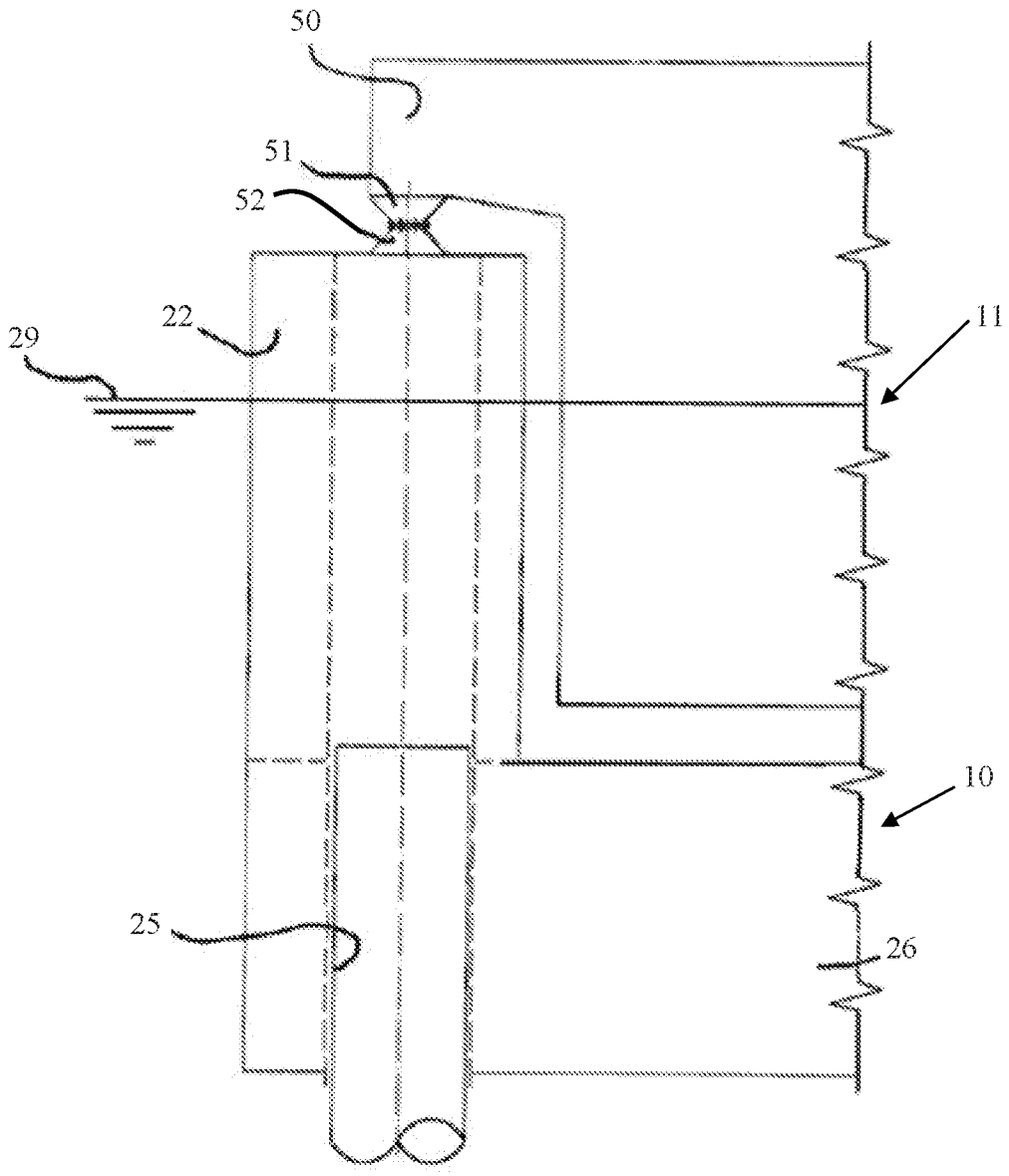
FIG. 17 shows schematically a side view of the fixture disclosed in FIG. 16, showing details of the position of the floater with respect to the pilings and with respect to the top surfaces of the base structure.

FIG. 17 shows schematically a side view of the fixture disclosed in FIG. 16, showing details of the position of the floater with respect to the pilings and with respect to the top surfaces of the base structure. As shown there is also a space between the upper surface of the beams 26 and the lower bottom surface of the floater, allowing the buoyancy of the floater to be varied by pumping ballast out or into the floater 11, the floater still being fixed to the base structure by means of the bracket connections 51, 52.

As indicated in FIG. 17, the piles 25, which are piled from above sea level 29, are terminated below sea level 29, allowing a simple and effecting piling operations and also reducing the weight and the cost. The pile casing may be closed at the top by a plate structure and the bracket connections 51, 52 may either be positioned between two neighbouring pile casings, or on top of said pile casings.

According to the embodiments disclosed, one or two rows of piles are disclosed. It should be appreciated, however, that the number of rows may be more than two.

In the embodiments disclosed vertically oriented piles are shown. It should be appreciated, however, that one or more of the piles may be inclined downwards and laterally out from the base structure.

According to the embodiments shown the piles are terminated at the upper end surface of the side walls 22. It should be appreciated, however, that the piles may be terminated inside the side walls 22 at a lower level than the upper surface, saving length of piles used.

The invention claimed is:

1. A method for mooring a floating body (11) in a harbour plant, wherein the harbour plant comprises a piled base structure (10) provided with two side walls (22) projecting upwards through a sea level (29) and terminated above sea level (29); and a laterally arranged bottom structure (26) rigidly interconnecting the side walls (22), wherein a top surface of the bottom structure (26) is arranged at a depth allowing the floating body (11) to be floated in between the two side walls (22), and wherein the floating body (11) is provided with a sideways projecting part and is arranged to be rigidly, but releasably supported by at least parts of the side walls (22), the method comprising bringing the floating body (11) into a position between the side walls (22), with at least part of the sideways projecting part positioned above the side walls (22); and fixing rigidly the floating body (11) to the vertical side walls (22) of the base structure (10), while still exposing the floating body (11) fully to buoyancy by allowing a water filled gap at least between a bottom of the floating body (11) and a corresponding upper surface of the base structure (10), preventing relative vertical motion between the floating body (11) and the base structure (10), wherein fixing rigidly the floating body (11) to the vertical side walls (22) of the base structure (10) comprises fixing a bracket (51) and a complementary bracket (52) to each other, the bracket (51) being fixed to an interface surface of the sideways projecting part and the complementary bracket (52) being fixed to a supporting surface at a top of the side walls (22), in which the interface surface and the supporting surface are arranged to face each other and the supporting surface is positioned atop a pile of the piled base structure (10) or between adjacent piles of the piled base structure (10).

2. The method according to claim 1, wherein fixing rigidly the floating body (11) to the vertical side walls (22) of the base structure (10) further comprises arranging a number of tensioning devices (39) between the floating body (11) and an upper part of the side walls (22), the tensioning devices (39) being arranged to rigidly fix with one end to a strongpoint on a side wall of the sideways projecting part of the floating body (11) and the opposite end arranged to rigidly fix to the upper part of the side walls (22).

3. The method according to claim 2, wherein a part of the weight of the floating body (11) is supported by buoyancy and, when sea level increases, ballast water is added to the floating body and/or uplifting forces are compensated for by the tensioning devices (39).

4. The method according to claim 2, wherein tension in the tensioning devices (39) is adjustable in order to secure sufficient supporting and fixing force.

5. The method according to claim 1, further comprising allowing a surface on the floating body (11) to rest on an upper end surface of the side walls (22) in close association with upper ends of piles (25) supporting the base structure (10) and extending through the side walls (22) and into a sea bed (30).

6. The method according to claim 1, further comprising providing the floating body (11) with strongpoints on a bottom surface of the sideways projecting part of the floating body (11) and above the top of the side walls (22) of the base structure (10), wherein the top surface of the side walls (22) is provided with correspondingly arranged complementary strongpoints configured to carry at least a part of the weight of the floating body (11).

7. The method according to claim 6, wherein the strongpoints on the top surface of the side walls (22) are formed by a top end of piles (25) serving as a foundation for the base structure (10), allowing the weight from the supported floating body (11) to be transferred directly through the piles (25) into sea bed (30).

8. The method according to claim 6, wherein jacks are arranged between the strongpoints on top of the side walls (22) and below the bottom of the strongpoints on the bottom surface of the sideways projecting part of the floating body (11) to allow lifting of the floating body (11) in order to achieve optimal weight and/or buoyancy balance between the base structure (10) and the floating body (11); and between the assembled based structure (10) and the floating body (11) and the piled interface to the sea bed (30) and/or functioning as shock absorbers.

9. The method according to claim 1, wherein dampening devices are arranged on a top surface of the side walls (22), configured to serve as shock absorbers during mating of the floating body (11) on the base structure (10).

10. The method according to claim 3, further comprising allowing a surface on the floating body (11) to rest on a surface on an upper end surface of the side walls (22) in close association with upper ends of piles (25) supporting the base structure (10) and extending through the side walls (22) and into a sea bed (30).

11. The method according to claim 1, wherein the bracket (51) and the complementary bracket (52) are welded to each other.

12. A harbour plant for mooring of a floating body (11), the harbour plant comprising a piled base structure (10) provided with two side walls (22) projecting upwards through a sea level (29) and interconnected by a laterally arranged bottom structure (26), and a floating body (11), wherein the base structure (10) is configured to be supported by a sea bed by means of a number of piles (25) terminated at a top surface of the side walls (22) above the sea level (29) or within the side walls (22) below the sea level (29), the floating body (11) is provided with a sideways projecting part and is arranged to be rigidly, but releasably supported by at least parts of the top surface of the side walls (22), a top surface of the bottom structure (26) is arranged at a depth allowing the floating body (11) to be floated in between the two side walls (22) with at least part of the sideways projecting part positioned above the side walls (22), the side walls (22) are configured to carry the weight of the floating body (11) through a rigid, but releasable fixture and still allow a water filled gap at least between a bottom of the floating body (11) and a corresponding upper surface of the base structure (10), and the fixture comprises a bracket (51) and a complementary bracket (52) configured to be fixed to each other, the bracket (51) being fixed to an interface surface of the sideways projecting part and the complementary bracket (52) being fixed to a supporting surface at a top of the side walls (22), in which the interface surface and the supporting surface are arranged to face each other and the supporting surface is positioned atop a pile of the piled base structure (10) or between adjacent piles of the piled base structure (10).

13. The harbour plant according to claim 12, wherein strongpoints on the floating body (11) are arranged on a bottom surface of the sideways projecting part of the floating body (11) and above the top of the side walls (22) of the base structure (10), the top surface of the side walls (22) being provided with correspondingly arranged complementary strongpoints configured to carry at least a part of the weight of the floating body (11).

14. The harbour plant according to claim 12, wherein a number of tensioning devices (39) are arranged between the floating body (11) and the top of the side walls (22), preventing relative vertical motion between the floating body (11) and the base structure (10).

15. The harbour plant according to claim 14, wherein the tensioning devices (39) are rigidly fixed with one end to strongpoints on the floating body (11) and the opposite ends being rigidly fixed to strongpoints at the upper end of the side walls (22).

16. The harbour plant according to claim 14, wherein each tensioning device (39) is provided with a device for adjusting the tension in order to securing sufficient supporting and fixing force.

17. The harbour plant according to claim 15, wherein jacks are arranged between the strongpoints on top of the side walls (22) and below the bottom of the strongpoints on the bottom surface of the sideways projecting part of the floating body (11) to adjust the tension in the tensioning devices (39).

18. The harbour plant according to claim 12, wherein strongpoints on the top surface of the side walls (22) are formed by the top end of piles (25) serving as a foundation for the base structure (10), allowing the weight from the supported floating body (11) to be transferred directly through the piles (25) into the sea bed (30).

19. The harbour plant according to claim 12, wherein strongpoints on the top surface of the side walls (22) correspond to or are in close association with the upper end of piles (25) supporting the base structure (10) and extending through the side walls (22) and into the sea bed (30).

20. The harbour plant according to claim 18, wherein the piles (25) are arranged to terminate at the top surface of the side walls (22), above the sea level (29).

* * * * *